United States Patent [19]

Zamboni

[11] Patent Number: 4,539,790

[45] Date of Patent: Sep. 10, 1985

[54] APPARATUS FOR THE CONTINUOUS WRAPPING OF SWEETS OR LIKE PRODUCTS IN A SO-CALLED DOUBLE TWIST WRAPPER

[75] Inventor: Alderino Zamboni, Budrio, Italy

[73] Assignee: Risvin - Ricerche e Sviluppo Industriale S.r.l., Budrio, Italy

[21] Appl. No.: 522,185

[22] Filed: Aug. 10, 1983

[30] Foreign Application Priority Data

Aug. 18, 1982 [IT] Italy ..... 3511 A/82

[51] Int. Cl.[3] ..... B65B 11/34

[52] U.S. Cl. ..... 53/227; 53/370

[58] Field of Search ..... 53/225, 227, 228, 234, 53/370; 198/377, 443, 478, 480

[56] References Cited

U.S. PATENT DOCUMENTS

| | | | |
|---|---|---|---|
| 2,206,267 | 7/1940 | Schutz et al. | 198/377 |
| 2,744,370 | 5/1956 | Seragnoli | 53/277 X |
| 3,208,579 | 9/1965 | Perrier et al. | 198/377 X |
| 3,797,198 | 3/1974 | Fukuzaki | 53/227 X |
| 3,899,865 | 8/1975 | Revaz | 53/227 X |
| 3,987,605 | 10/1976 | Johnson | 53/370 X |
| 4,408,435 | 10/1983 | Sutton | 53/234 X |

FOREIGN PATENT DOCUMENTS 134621 3/1979 Fed. Rep. of Germany ..... 53/227

*Primary Examiner*—Paul A. Bell

*Attorney, Agent, or Firm*—Karl F. Ross; Herbert Dubno

[57] ABSTRACT

An apparatus for continuously wrapping sweets or like products in a so-called double twist wrapper, comprising a rotary wheel which moves continuously about a horizontal axis, a plurality of handling devices having oscillating heads mounted to be radially slidable at a uniform spacing on the rotary wheel, with the axis of oscillation of the said oscillating head parallel to the axis of rotation of the rotary wheel, and means having gripper take up elements and hoe-shaped folding elements supported by the said head so as to oscillate about respective axes parallel to the axis of oscillation of the oscillating head and the axis of rotation of the said rotary wheel. The said handling device support wheel has provided coaxially rotatable therewith and on its opposite sides two wheels supporting a corresponding respective plurality of twisting devices in mirror symmetry on the opposite sides of the above-mentioned means having gripper take up elements and folding elements supported by the said head.

4 Claims, 7 Drawing Figures

Figure 1:
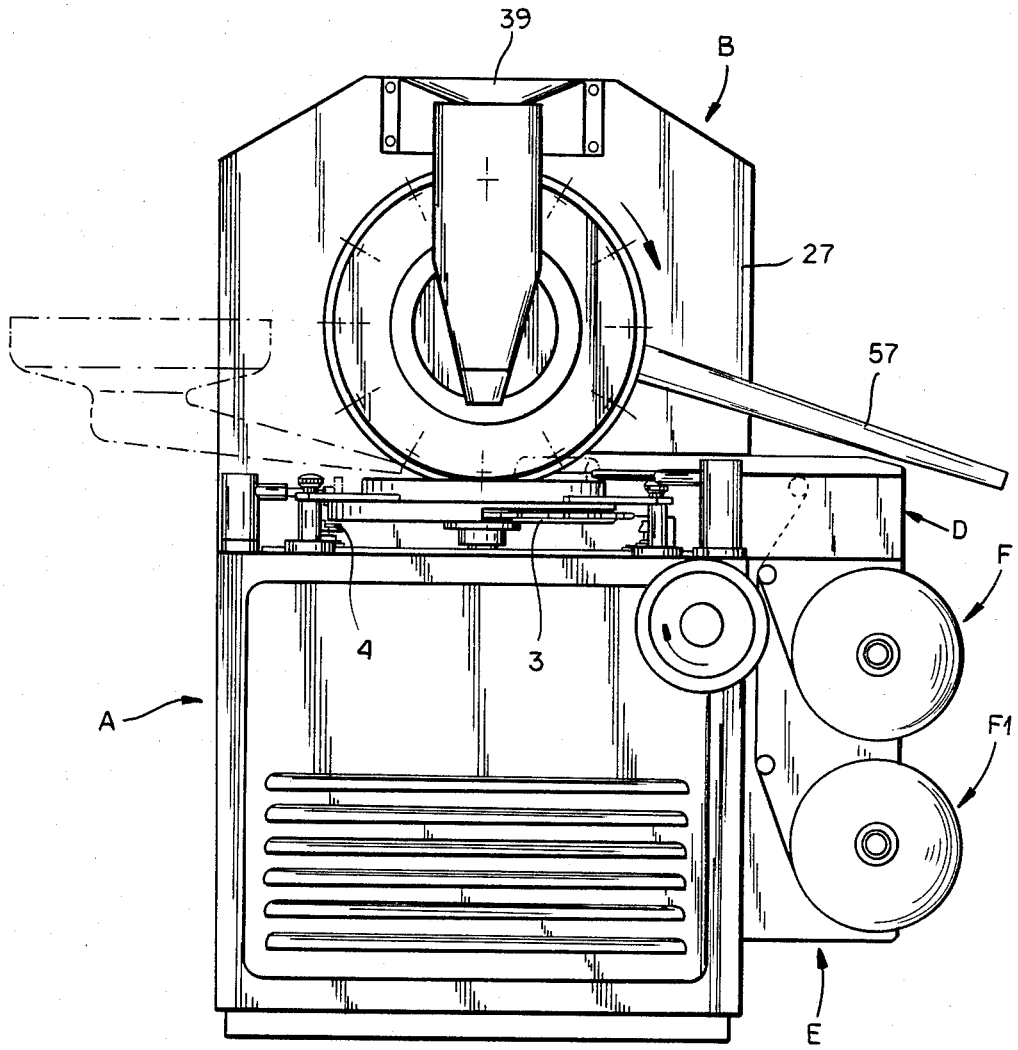

APPARATUS FOR THE CONTINUOUS WRAPPING OF SWEETS OR LIKE PRODUCTS IN A SO-CALLED DOUBLE TWIST WRAPPER

DESCRIPTION

The present invention relates to an apparatus for the continuous wrapping of sweets or like articles in a so-called double twist wrapper shape.

The handling of products or articles such as sweets and the like in order to provide these for example with a wrapper is normally carried out by conveying these products or articles along a circular path for the formation of this wrapper by means of folding means supported completely or in part by conveyor members provided with a discontinuous movement, i.e. periods of movement alternating with rest periods, at which means the products are themselves subjected to almost all the folding operations and/or the passage or transfer of these products or articles from one conveyor member to a subsequent member.

In the case of handling devices designed in this way, i.e. having conveyor members provided with a discontinuous movement in order to enable the products to be subjected to the majority of the abovementioned folding operations and/or the transfer of the products themselves from a conveyor member to a further member during the rest periods of each alternation, the unit operating speed is necessarily somewhat limited which obviously leads to increased production costs.

In order to increase the unit operating speed of the above handling devices so as to decrease production costs for the corresponding products which are obtained and/or treated, various types of device or apparatus defined commercially as having a continuous movement have been proposed, although in actual practice these devices have proved to be nothing more than hybrids since, or at least during the stage of transfer of the product to be treated from operating means of a conveyor member to subsequent means of a further conveyor member, the product is at rest as it is released from the operating means of the preceding conveyor member or brought to a standstill by stop means and thus contacted for checking or taking up by the operating means of the following conveyor member with possible damage to the product itself and, in any case, with drawbacks relating to uniformity in the subsequent conveyor stage (see German Patent Specification No. 2416656) or even because these operating means are disposed facing away from one another at a single tangential point at the time of take-up of the product for its passage from one conveyor element to the next (see U.S. Pat. No. 3,001,351), or because the operating means are provided with a constant, i.e. high, circular conveying speed even for the more delicate handling operations such as, for example, the transfer or passage itself of the product from one conveyor element to the next, or even the more delicate operation of checking or taking up of the product and the various elements, such as wrapping material, which may be involved in the handling operation, in particular during the supply stage to the operating means of the respective conveyor members.

The applicant's copending U.S. Pat. No. 433,552, filed Oct. 8, 1982, discloses a method and a device for the handling of products by means of operating means caused to move continuously along a path having a mixed course with sections which are rectilinear, spiral, circular and curved in any way and which follow one another, although in an intercalated manner and at different speeds in accordance with the type of operation to be carried out on the product.

In accordance with this method and device, the individual products or articles of a series of products or articles to be handled or treated are conveyed in the first place, for example, along a path section having a rectilinear course at a low speed in order to provide improved control during their supply stage to the operating means and thus, once under control by the said operating means, along a path having a curved course at a gradually increasing speed so as to space them and subject them to particular operations, and then along a rectilinear path at a different speed for a further operation, and so on in accordance with the number and type of operations to be carried out with respect to the type of product to be treated.

In this way it is obvious that there is a particular consequent possibility of carrying out operations for transfer or passage of products or articles to be treated from the operating means of a conveyor member to the operating means of a subsequent conveyor member, for example along the one of the sections of the path having a rectilinear course, even at a slower speed, completely cancelling out any relative speed irrespective of the conveyor speed level.

In accordance with the above-mentioned U.S. Pat. No. 433,552, the said continuously moving conveyor members are preferably provided as wheels having radial support guides on which are slidably mounted the operating means having support constructions with which are associated means for their movement along the respective radial support guide in order to move them away from and/or towards the axis of rotation of the corresponding continuously moving conveyor member such that they are continuously displaced along the above-mentioned path having mixed sections and at different speeds. The operating means provided are of the type comprising heads with take-up elements having a permanent magnet or suction effect, or are constituted by gripper take-up elements, whilst the means for displacing the said operating means along the respective radial support guide are, for example, of the type having a common actuation cam, or an individual actuation cam, for example using motors of the so-called step-by-step type or other like actuation means. In addition during the stage for the transfer or passage of the product from the operating means of a conveyor wheel element to the operating means of a further conveyor wheel element operating along a rectilinear section the said operating means are orientated about respective axes parallel to the axes of the said respective conveyor wheel elements so as to maintain constant the orientation of the product along the entire rectilinear transfer section. Finally, the axes of the operating means parallel to the axes of the respective conveyor wheel elements may be provided, in terms of the combination with the said conveyor wheel elements, such that they are all parallel or, respectively, perpendicular.

In accordance with the applicant's further copending U.S. Pat. No. 522,183, filed on Aug. 10, 1983, there is provided a handling device having gripper take-up elements and folding elements for packing machines, designed to be supported with a continuous movement along a path having mixed sections and at different speeds and designed to maintain these gripper take-up elements in constant orientation along and relative to the mixed path sections so as to completely cancel out, at the moment of take-up of the product, any relative speed with respect to the product to be wrapped irrespective of the conveyor speed level of the product itself. This constant orientation of the said gripper take-up means is provided about an axis parallel to the axis about which the said path having mixed sections is carried out.

The object of the present invention is to provide an apparatus for the continuous wrapping of sweets or like products or articles in a so-called double twist wrapper shape, by means of which all the operations for the transfer and formation of the wrapper are carried out with the sweets in continuous movement, these operations including the supply or transfer of the sweets with respective wrapping materials from the device or apparatus for supply to the handling elements of the wrapping apparatus along a horizontal rectilinear section which simulates rest in order to compensate the relative speeds among the sweets and their associated wrapping materials and the gripper take-up elements for transfer and conveyance and the folding elements for producing the wrappers around the sweets by means of the gripper take-up elements and folding elements along a circular path.

The present invention therefore relates to an apparatus for continuously wrapping sweets or like articles or products in a so-called double twist wrapper, which apparatus is characterised in that it comprises a supply device for supplying with a continuous movement a sequence of equally spaced sweets along at least one rectilinear horizontal section, a rotary wheel moving continuously about a horizontal axis supporting in an equally spaced arrangement in a radially slidable manner a plurality of handling devices having heads oscillating about an axis parallel to the said horizontal axis of rotation of the rotary wheel and supporting means having gripper take-up elements which may be moved for opening and closing in the plane of rotation of the above-mentioned rotary wheel having a horizontal axis and hoe-shaped folding means, the said rotary wheel having a horizontal axis being supported such that the said means having gripper take-up elements and the said hoe-shaped folding means are located in sequence above and along the rectilinear horizontal supply line for the sweets, two wheels each supporting a corresponding plurality of twisting devices having gripper take-up elements, which wheels are mounted rotatably with a continuous movement with and at the opposite sides of the said rotary wheel supporting the handling devices with the said means having gripper take-up elements of the twisting devices in mirror symmetry facing away from the opposite sides of the above-mentioned means having gripper take-up elements of the said handling devices, movement transmission means enabling the synchronous actuation of the supply device and the rotary wheels having horizonal axes along at least the rectilinear horizontal section, cam means for the radial actuation of the handling devices and for causing the oscillation of the oscillating head in order to orientate the respective means having gripper take-up elements parallel and perpendicular to, at the level of and along the said rectilinear horizontal section, and cam means for actuating the said means having gripper take-up elements of the handling and twisting devices respectively for closure along the said rectilinear horizontal section and at the end thereof, as well as the said hoe-shaped folding means.

Figure 2:
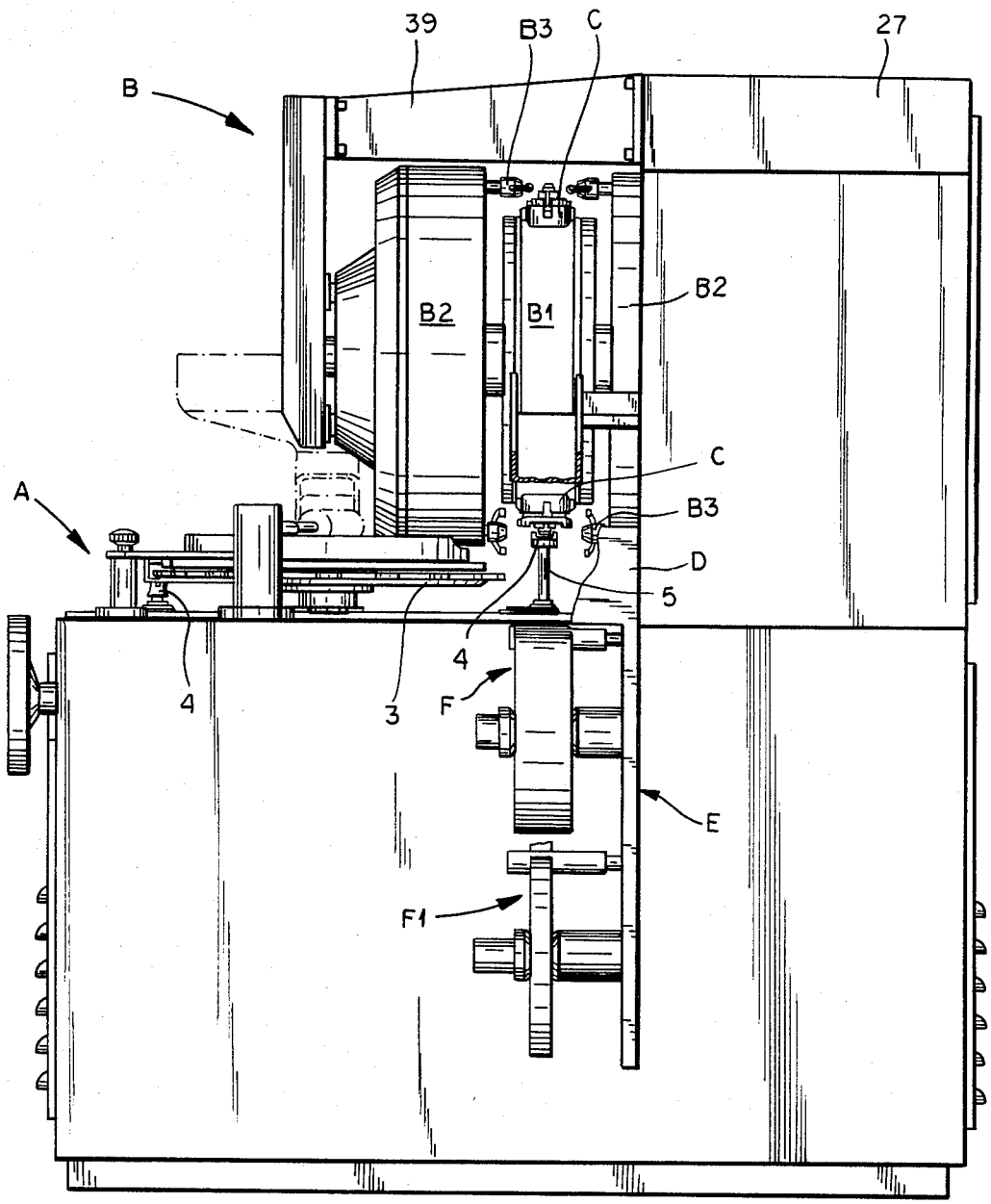
Figure 3:
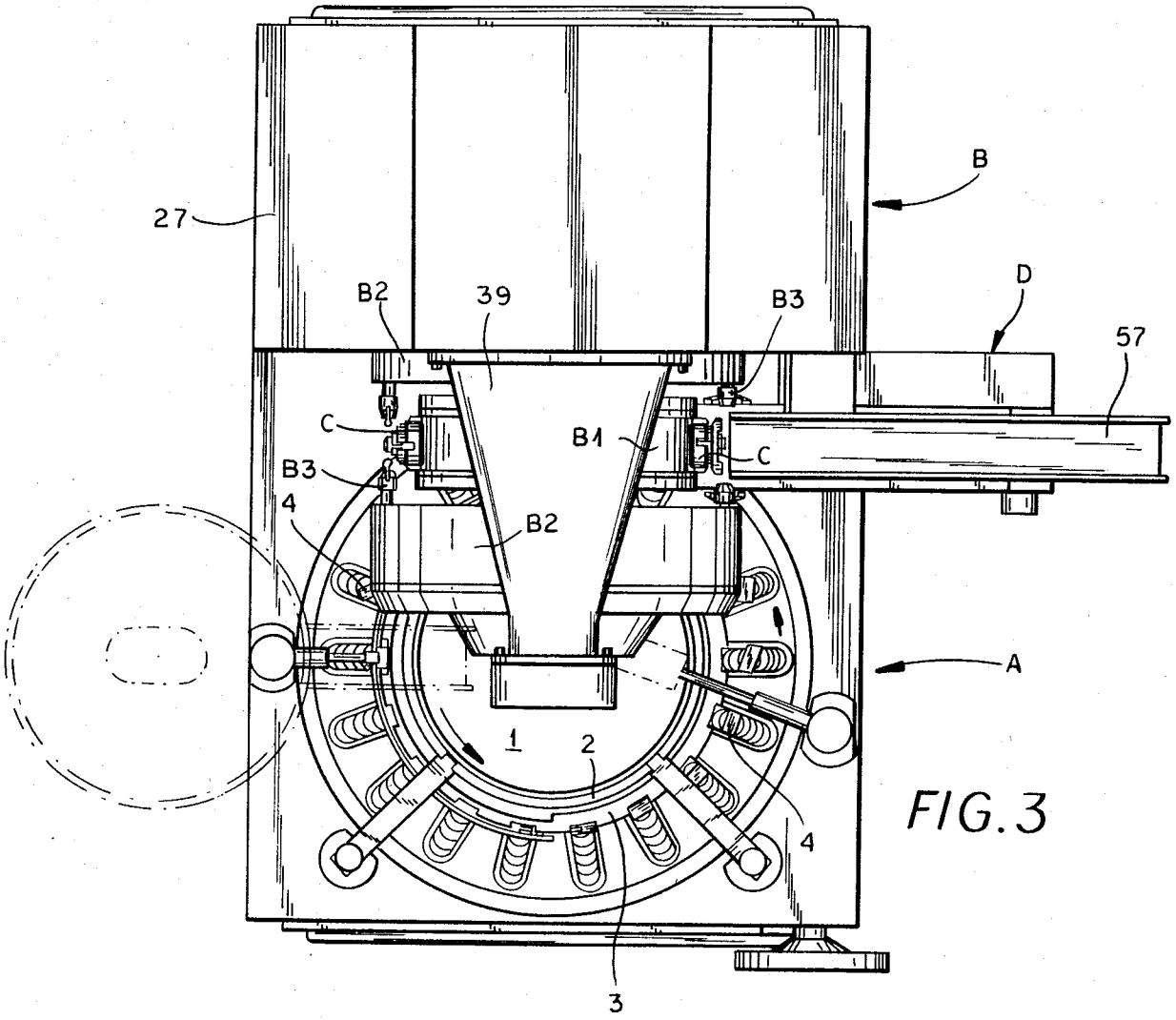
Figure 4:
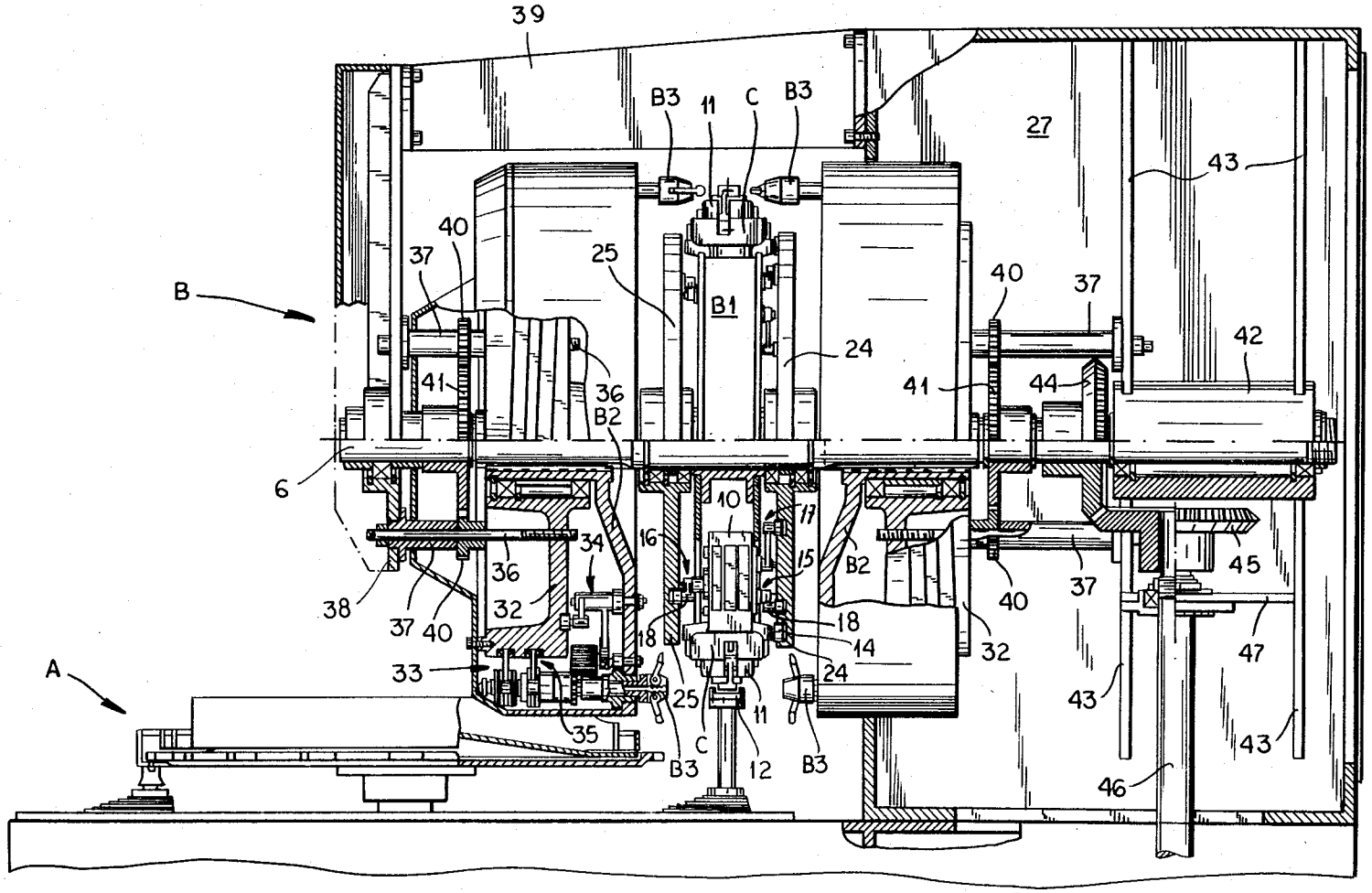
Figure 5:
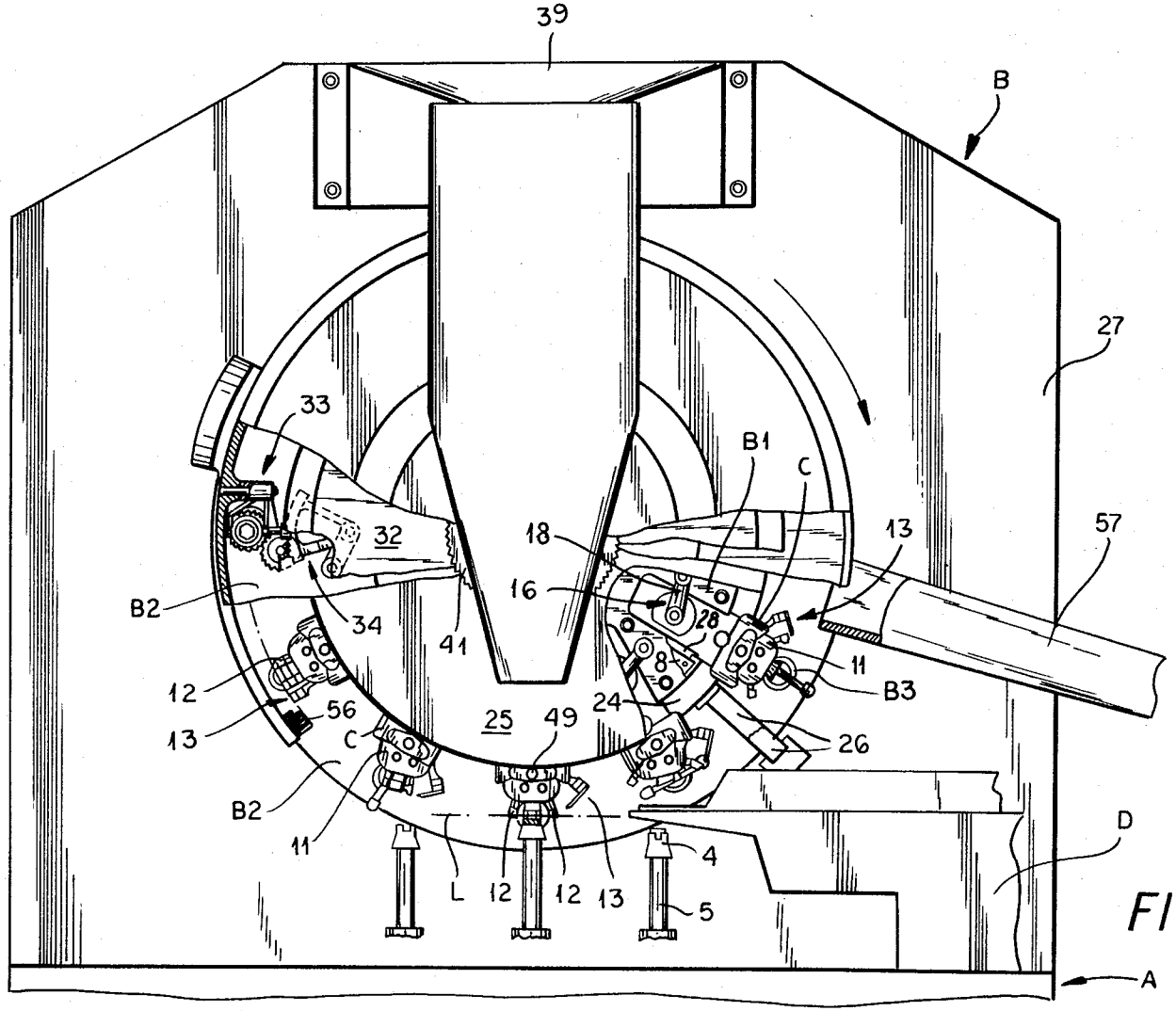
Figure 6:
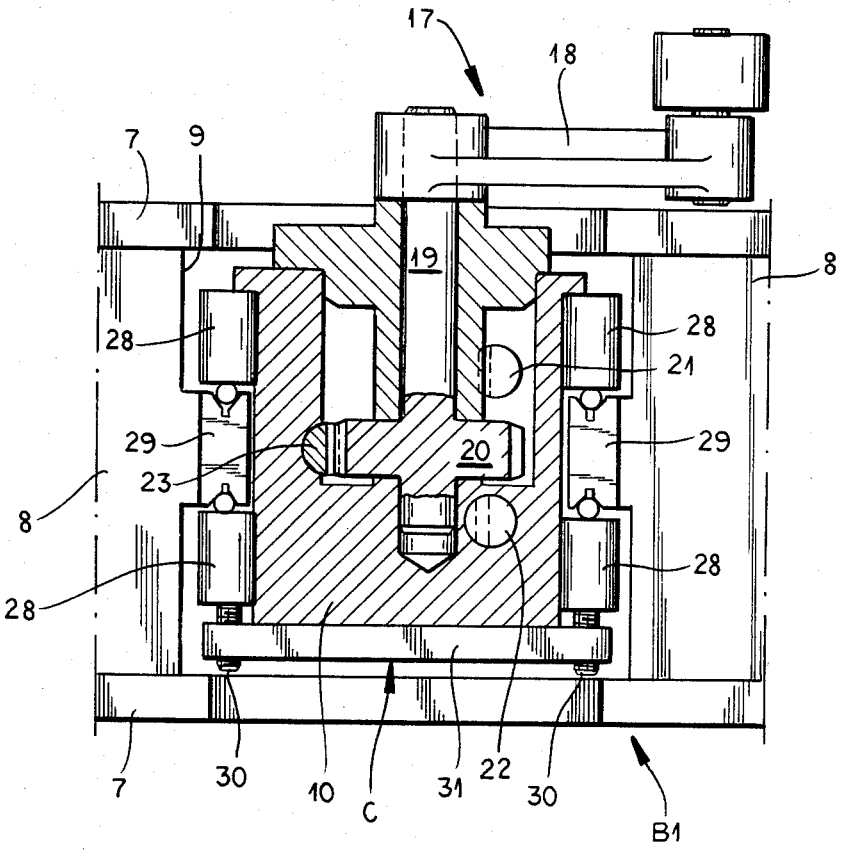
Figure 7:
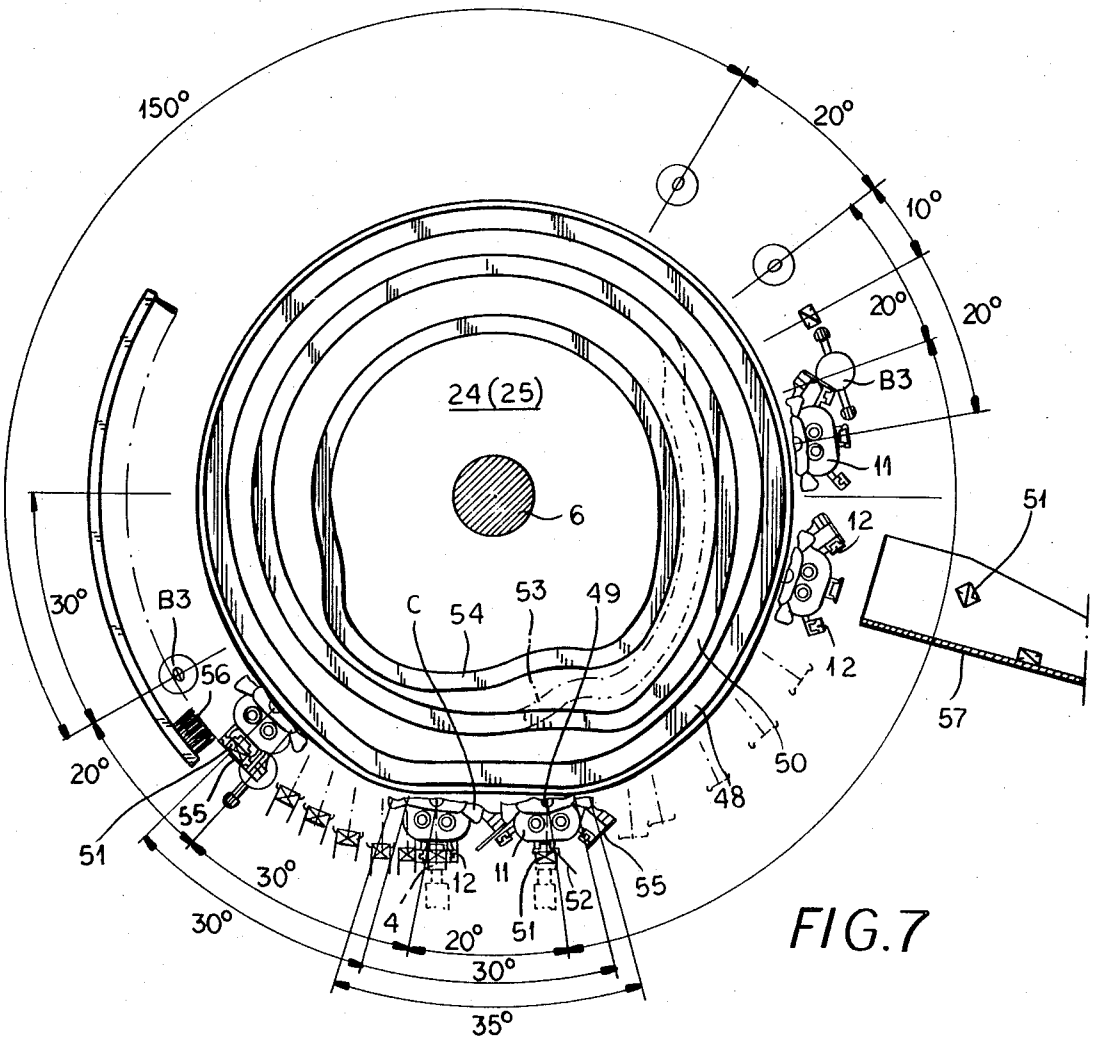

In the drawings there is illustrated by way of non-limiting example a preferred practical embodiment of the continuous wrapping apparatus of the invention, and more particularly:

FIGS. 1, 2 and 3 show this embodiment in combination with an apparatus for the supply of the products to be wrapped so as to form a high speed continuous wrapping machine, a front external view being shown in FIG. 1, a lateral external elevation in FIG. 2 and a top view in FIG. 3, FIG. 4 is a vertical axial section on an enlarged scale, FIG. 5 is a front view on an enlarged scale with certain components cut away and others shown in section in order to show further components, FIG. 6 is a detail of the wrapping machine on a further enlarged scale and FIG. 7 is an explanatory diagram of the operational stages required for the formation of the wrapper.

The wrapping apparatus in question is described with respect to a continuously moving wrapping machine construction designed to wrap sweets at high production speeds, i.e. approximately 2000 (two thousand) sweets in the first minute, in a so-called double twist wrapper, using a plurality of handling devices in accordance with the above-mentioned U.S. Pat. No. 522,183 and the continuously moving apparatus for the spacing of products in accordance with the applicant's further copending U.S. Pat. No. 522,184, filed Aug. 10, 1983, designed to supply the sweets in sequence to the said handling devices in combination with the present wrapping apparatus.

In FIGS. 1, 2 and 3 the apparatus for the spaced supply of the sweets constituting the lower portion of the wrapping machine is shown by A, the present wrapping apparatus by B, constituting the upper portion of the said wrapping machine and the said handling devices by C, these devices being associated in the manner illustrated below with the continuously moving wheel portion B1 of the present wrapping apparatus B, and in which D shows an apparatus of known type for cutting the strip of wrapping material and supplying pieces of this material for wrapping the sweets, substantially disposed at the horizontal plane of intersection between the said lower sweet supply apparatus A and the present upper apparatus B for wrapping the sweets, E being a support structure designed to support spools of wrapping material in strip form F and F1, also of known type, disposed below the said cutting and supply apparatus D for the pieces of wrapping material.

The spaced supply apparatus A for the sweets is of the type according to the above-mentioned Patent Application in the name of the applicant U.S. Pat. No. 522,184 and has a coaxially rotatable superimposed wheel construction moving continuously about a vertical axis. For further details of the operational configuration of this spaced supply apparatus with superimposed wheels A for the sweets, reference should be made to the patent specification. It essentially comprises a first upper plate wheel 1 designed to receive the sweets in bulk and to supply them in single file via a spiral duct 2 to the periphery of a second lower disc wheel 3 provided peripherally with a plurality of peripherally open equally spaced apertures. Below each of the peripherally open apertures there is provided a corresponding take-up element means 4 associated with a vertical rod 5 supported in a radially and axially slidable manner which may also be orientated about its vertical axis, by a lower third rotating wheel supported within its base and consequently not visible in the attached drawings. The take-up element means 4 receive a sweet housed in the the peripheral apertures of the upper wheel 3 and displace it from the peripheral path of the said second and third wheels along a rectilinear horizontal path section L below the continuously moving wheel portion B1 of the present wrapping apparatus B, maintaining it in constant orientation with respect to the said rectilinear horizontal path section, along which it is removed with its associated piece of wrapping material by a corresponding handling device C associated, as will be illustrated below, with the said continuously moving wheel B1 of the wrapping apparatus B.

The apparatus B essentially comprises the said continuously moving wheel portion B1 with associated handling devices C, as stated above, and two twist device support wheels B2, also moving continuously, as will be further explained below. The continuously moving wheel portion B1 and the two wheels B2 supporting the twist devices B3 are keyed on a horizontal shaft 6 (see FIG. 4) lying in a vertical plane passing through the vertical axis of co-rotation of the three superimposed wheels belonging to the supply apparatus A, with the wheel B1 rotating in a fixed median plane containing the rectilinear horizontal path section L along which are caused to pass in succession the take-up element means 4 maintained in constant orientation along and with respect to the rectilinear horizontal path section L of the supply apparatus A, and with the two wheels B2 in mirror symmetry at the opposite sides of the wheel B1 so that they may be slidably adjusted, for the function and in the manner described below, along the horizontal shaft 6 with respect to the wheel B1.

The wheel B1 is substantially constituted (see FIG. 6) by two discs 7 facing away from one another, between which there is fixed a plurality of segmental elements 8 forming a corresponding plurality of cavities 9, in each of which there is slidably mounted in a radial manner as described below a handling device C of the type of the above-mentioned U.S. Pat. No. 522,183. The said handling device C is constituted (see in particular FIG. 6) by an elongate polygonal prismatic support 10 which may be associated in a predetermined number at an equal spacing with a continuously moving rotary wheel in a radially slidable manner, by a headed body 11 mounted articulatedly to oscillate at the radially outermost end of the support body 10 about an axis parallel to the axis of rotation of the rotary wheel (see in particular FIGS. 4 and 5), by operating means having gripper take-up elements 12 and hoe-shaped folding elements 13 supported in an articulated manner so as to oscillate by the oscillating headed body 11 about respective axes parallel to the axis of oscillation of the oscillating headed body 11 and to the axis of rotation of the rotary wheel, and by control means 14 for moving the support body 10 radially with the associated oscillating headed body 11 supporting the operating means having gripper take-up elements 12 and hoe-shaped folding elements 13 which oscillate and for causing the oscillation 15 of the oscillating headed body 11 and the independent respective oscillations 16 and 17 of the operating means having gripper take-up elements 12 and hoe-shaped folding elements 13 in order to cause these latter to perform a movement of constant orientation along and relative to a path of continuous conveyor movement having mixed sections which are rectilinear, spiral, circular and curved in any way which follow one another in an intercalated manner and at different speeds in accordance with the type of operation to be carried out on the product, completely compensating any relative speed with respect to the latter irrespective of its conveyor speed level. The control means 15, 16 and 17 are of the lever type 18 with a cam follower idler leading to a pin 19 rigid with a gear 20 in engagement with a corresponding respective rack 21, 22 and 23 leading, in turn, to the oscillating head 11, to the operating means having gripper take-up elements 12 and to the hoe-shaped folding means 13 respectively. The cam follower idlers leading to a respective lever 18, as well as that of the control means 14 for the radial sliding of the individual handling devices C are engaged in corresponding cam actuation paths provided in two discs 24, 25 disposed coaxially in a free manner on the horizontal shaft 6 in mirror symmetry on the opposite sides of the wheel B1, between the latter and the wheels B2 supporting the twisting devices B3. These cam actuation path discs 24 and 25 are maintained in a fixed manner on the horizontal shaft 6 by means of a stirrup element 26 having its end shaped as a fork whose prongs are fixed to the discs 24 and 25 and whose other end is fixed to the support base 27 for the wrapping apparatus B (see FIG. 5).

The radial displacement of the handling device C associated with the wheel B1 takes place by means of slide guide mechanisms and ball bearing recycling devices of the type available on the market under the tradename SK, produced and sold by the international company Schneeberger. These ball bearing recycling elements, shown by 28 are fixed, in the case shown by way of example, see FIG. 6, in pairs to two opposite faces of the body 10 of the handling devices C, whilst the slide guides, shown by 29, are fixed to corresponding opposite faces of the segmental elements 8 forming the individual radial cavities or spaces 9 provided in the wheel B1 with which the handling devices C are associated. The adjustment or setting of these mechanisms is carried out by adjustment screws 30 which may be screwed to plates or fillets 31 rigid with the body 10 and exerting a pressure on at least one of each pair of elements 28 (see FIG. 6).

As stated above, the horizontal shaft 6 on which the wheel B1 supporting the handling devices C is keyed also has mounted on it the two wheels B2 supporting the twisting devices B3 such that the latter are arranged in mirror symmetry on the opposite sides of and facing away from the handling devices C of the wheel B1. The handling devices C of the wheel B1 and the twisting devices B3 of the wheels B2, with an equal angular spacing on the respective wheels and in the above-mentioned aligned arrangement parallel to the horizontal shaft 6 are provided, in the case shown, in a number of twelve combinations, whilst eighteen of the take-up elements 4 of the supply apparatus A are provided, i.e. a ratio of two to three, such that the actuation means described below for the synchronized movement of rotation of the wheels B1 and B2 of the wrapping apparatus B and the take-up elements 4 of the supply apparatus A are dimensioned in this transmission ratio of two to three. The twisting devices B3 associated with the wheels B2 are of the known type having a gripper element which may be actuated for opening and closing by a slidable rack rod and with movements of rotation and axial sliding. These movements are carried out by means of cam paths provided in a fixed body 32 mounted coaxially in a free manner on the keying hub of the respective wheel B2 and via cam follower idler lever mechanisms shown respectively by 33, 34 and 35.

The assemblies formed in this way by the two wheels B2 with the twist devices B3 and the associated fixed bodies 32 with cam actuation paths are, as mentioned above, mounted on the horizontal shaft 6 in an axially slidable manner such that they may be moved towards or away from the wheel B1 which supports the handling devices C as a function of the product to be wrapped, i.e. as phrased in jargon as a function of format, without having to substitute machine components as is normally the case with the wrapping machines known up to now whether these are of the discontinuous movement type or of the so-called continuous movement type. The axial sliding movement along the keying broach provided in the horizontal shaft 6 for moving the assemblies constituted by two wheels B2 with twisting devices B3 and associated fixed bodies 32 with cam actuation paths towards and away from the wheel B1 supporting the handing devices C is carried out by respective threaded rods 36 which may be screwed into the fixed body 32 having cam actuation paths and which are freely supported in a rotatable manner in a bushing element 37 supported in a fixed manner by a vertical element 38 belonging to a bracket element 39 fixed to the base 27 and supporting in a free manner the left-hand end, seen in FIG. 4, of the horizontal shaft 6. A respective gear 40 in engagement with a gear 41 mounted freely on the horizontal shaft 6 is fixed to these threaded rods 36.

By acting on one of these threaded rods 36, for example the lower rod of FIG. 4, in order to rotate it in either direction, it is obvious that it is possible to move the said assemblies constituted by the wheels B2 with the twisting devices B3 and the associated fixed body 32 with cam actuation means towards or away from the the wheel B1 supporting the handling devices C thereby effecting adjustment to any format without the need to substitute any component. The horizontal shaft 6, in addition to being rotatably supported at its left hand end as stated above, is also rotatably supported at its right-hand end, as shown in FIG. 4, by means of a hub component 42 rigid with radial ribs 43 of the base 27 and is actuated with respect to its movement of rotation by a conical toothed crown gear 44 rigid therewith. The movement of the conical gear 44 is supplied by a conical gear 45 in engagement therewith and keyed on a vertical shaft 46 supported rotatably by a support plate 47 supported by the lower radial ribs 43. This vertical shaft 46 takes its movement of rotation as a result of the actuation of the horizontal shaft 6 and therefore of the wheels B1 supporting the handling devices C and B2 supporting the twisting devices B3 from the means for transmitting the movement to the supply apparatus A in the above-mentioned ratio of three to two.

FIG. 7 shows, as mentioned above, a diagram of operation showing the operating stages for carrying out the wrapping of a sweet, i.e. one of the plurality of handling devices C of the wrapping apparatus B described above and set out in the claims, fixed in an equally spaced arrangement to the wheel B1 of the rotary apparatus B continuously moving about the axis of the horizontal shaft 6 and provided for wrapping, for example, sweets in a so-called double twist wrapper shape.

As is known, this double twist wrapper shape involves the formation around the sweet to be wrapped of a tubular wrapper extending beyond the ends of the sweet over a certain length and the twisting of the opposite ends of this tubular wrapper in the vicinity of the ends of the sweet itself thereby producing this characteristic double twist wrapper shape.

The sweets to be wrapped are supplied to this wrapping apparatus B in horizontal alignment in a predetermined sequence or series by means of devices or apparatus of known type for the spacing of these sweets or like products, and in this case by the apparatus A of the above-mentioned U.S. Pat. No. 522,184. The wrapping material, which is normally wound in spools, is supplied using a horizontal arrangement by means of apparatus of known type. Consequently, with reference to FIG. 7, it can be seen that by way of example with respect to the gripper element 12 of the handling devices C there is provided a horizontal rectilinear path section L for the simulation of rest in the lower zone of the rotary wheel B1 corresponding to 35° of rotation of the said rotary wheel B1. This is carried out with the gradual radial displacement of the handling device C by means of the cam path 48 and the simultaneous gradual oscillation of the head 11 about the axis of the spindle 49 by means of the cam path 50 for a different orientation to the radial orientation of the same head 11 so as to achieve and maintain the parallelism of this head 11 and the perpendicularity of the plane of symmetry of the prongs or gripper arms of the gripper element 12 with respect to the horizontal plane of supply of the sweets and the associated wrapping material.

Of the above-mentioned 35° of horizontal rectilinear path for simulating rest, a good 30° are used to carry out the operation or stage of passage or transfer of the sweet 51 and the corresponding superimposed wrapping material 52 from the take-up elements 4 of the supply apparatus A to the gripper elements 12 of the handling devices C of the wheel B1, which gripper elements 12 close for take-up in the intermediate 20° under the action of the cam path 53. After the 30° of rest simulation and with the sweet and the associated wrapping material folded over it in the shape of an upturned U between the prongs of the closed gripper element 12, the head 11 is caused to oscillate during the following 30° so as to re-orientate it radially, whilst the hoe-shaped folding element 55 is caused to oscillate from the position of the closed gripper element 12 during the following 30° by means of the cam path 54 and folds the rear limb of the upturned U of the wrapping material over the lower face of the sweet. The hoe-shaped folding element remains in this position through a further 20° of rotation of the wheel B1, during which the sweet 51 reaches a fixed blade 56 which folds the other limb of the upturned U of the wrapping material over the previously folded limb thereby forming the tubular wrapper around the sweet.

During the said 20° of rest of the hoe-shaped folding element 55, the grip twisting element B3 are also closed in order to take up the ends of the tubular wrapper and, whilst the folding element returns to its initial position during the following 30° and remains there for the remaining 280° of rotation of the wheel B1, the grip twisting elements B3 are caused to rotate about themselves in order to twist these ends of the tubular wrapper over 150° gradually approaching the sweet. After this, the grip twisting elements B3 are moved further towards the sweet over the following 20° in order to carry out the so-called operation of compaction of the wrapping material in the twisted zone, and are then re-opened in the following 20° so as to release the sweet wrapped in the so-called double twist wrapper shape. Ten degrees after the beginning of opening of the grip twisting elements B3, the gripper element 12 also begins to open and continue to do so during the following 20° such that the sweet falls onto the chute conveyor 57 which supplies it for further possible operations of boxing, collection and storage for sale. In the meantime, the above cycle for wrapping the sweets is repeated.

A wrapping apparatus having the strcuture described above and set out in the attached claims in accordance with the invention, in practical combination with a predetermined number of handling devices C and with the supply apparatus A of the above-mentioned U.S. Pat. Nos. 522,183 and 522,184, has enabled the construction of wrapping machines having high production speeds and which may wrap up to and more than 2000 (two thousand) sweets in the first minute, which production speeds are absolutely impossible with and more than double that of wrapping machines at present available on the international market.

It is obvious that in the practical embodiment of the above construction of the wrapping apparatus in question any modifications and variants suggested by practice and by its case of application may be made thereto in all cases within the scope of the invention claimed below.

I claim:

1. Apparatus for the continuous wrapping of sweets or like products or articles in a so-called double twist wrapper shape, characterised in that it comprises a supply device for supplying with a continuous movement a sequence of equally spaced sweets along at least one horizontal rectilinear path section, a rotary wheel moving continuously about a horizontal axis supporting in an equally spaced arrangement in a radially slideable manner a plurality of handling devices having heads oscillating about an axis parallel to the said horizontal axis of rotation of the rotary wheel and supporting gripper take-up member means which may be moved for opening and closing in the plane of rotation of the said rotary wheel having a horizontal axis and hoe-shaped folding means, the said rotary wheel having a horizontal axis being supported such that the said gripper take-up member means and the said hoe-shaped folding elements are disposed in succession above and along the said horizontal rectilinear supply section for the sweets, two wheels each supporting a corresponding respective plurality of twisting devices having gripper take-up members, which wheels are rotatably mounted and move continuously with and at the opposite sides of the above-mentioned rotary wheel supporting the handling devices with the gripper take-up member means of the twisting devices in mirror symmetry and facing away from the opposite sides of the gripper take-up member means of these handling devices, means for transmitting movement for the synchronous actuation of the said supply device and the rotary wheels having a horizontal axis at least along the horizontal rectilinear section, cam means for the radial actuation of the handling devices and for causing the oscillation of the oscillating head in order to orientate the respective gripper take-up memebr means parallel and perpendicular to, at the level of and along the rectilinear horizontal section, and cam means for actuating the the gripper take-up member means of the handling devices and twisting devices for closure along the horizontal, rectilinear section and at the end thereof respectively, as well as for actuating the hoe-shaped folding elements.

2. An apparatus as claimed in claim 1, characterised in that the supply device is of the type having superimposed wheels rotating at a different speed about a vertical axis and in that the horizontal common axis of rotation of the wheel supporting the handling devices and the two symmetrical wheels supporting the twisting devices lies in a vertical plane passing through the vertical axis of rotation of the superimposed wheels of the said supply device so as to be radial with respect to these superimposed wheels.

3. An apparatus as claimed in claim 2, characterised in that the said superimposed wheels are associated with an equally spaced number of means having gripper elements for the take-up of individual products such as to constitute with respect to the number of handling devices and twisting devices respectively supported by the wheels a ratio of transmission of the synchronized movement between these respective wheels of two to three.

4. An apparatus as claimed in claim 1, characterised in that the two wheels each supporting a plurality of twisting devices having gripper take-up member means are associated with a corresponding fixed body having cam actuation paths for the said twisting devices having gripper take-up member means by means of lever mechanisms having cam follower idlers, the two wheels with the associated fixed bodies having cam actuation paths being keyed on the keying shaft of the wheel supporting the handling devices having oscillating heads such that they may be slidably adjusted along this keying path with respect to this wheel supporting handling devices having oscillating heads so as to move towards or away from this latter wheel.

* * * * *